United States Patent [19]

Hendriksma

[11] 4,286,036

[45] Aug. 25, 1981

[54] PROCESS FOR REVERSAL DEVELOPMENT

[75] Inventor: Roelof R. Hendriksma, Panningen, Netherlands

[73] Assignee: Océ-Nederland B. V., Venlo, Netherlands

[21] Appl. No.: 136,838

[22] Filed: Apr. 3, 1980

[30] Foreign Application Priority Data

Apr. 2, 1979 [NL] Netherlands ..... 7902539

[51] Int. Cl.[3] ..... G03G 13/09

[52] U.S. Cl. ..... 430/100; 430/122; 430/900; 430/79; 430/81; 430/82; 430/35; 355/3 CH

[58] Field of Search ..... 430/39, 100, 122, 35, 430/900

[56] References Cited

FOREIGN PATENT DOCUMENTS

| | | |
|---|---|---|
| 2810854 | 9/1978 | Fed. Rep. of Germany . |
| 549823 | 10/1972 | Switzerland . |
| 0954052 | 4/1964 | United Kingdom . |
| 0959668 | 6/1964 | United Kingdom . |
| 1370197 | 10/1974 | United Kingdom . |
| 1412350 | 11/1975 | United Kingdom . |

OTHER PUBLICATIONS

Schaffert, Electrophotography, J. Wiley & Sons, (1975) pp. 242–245.

*Primary Examiner*—John D. Welsh
*Attorney, Agent, or Firm*—Albert C. Johnston

[57] ABSTRACT

For reversal development of an electrical potential pattern formed by imagewise exposure of a uniformly charged photoconductive layer, the charging of the layer is restricted to such a level below its breakdown voltage that the contact between the photoconductive layer and the toner powder used in the development step is insulating, and a magnetizable and inductively attractable toner powder is applied for the development. The toner powder is applied by means of a magnetic brush device comprising a conductive development roller which is provided with an electrical potential suited for reversal development. Preferably the photoconductive layer is charged to a level of at most 35–75% of its breakdown voltage, and a scorotron preferably is used for the charging. The photoconductive layer may comprise a photoconductive polymer and/or a bisazo pigment as photosensitive compound, or may be a layer of "pink" zinc oxide dispersed in a binder.

17 Claims, 4 Drawing Figures

PROCESS FOR REVERSAL DEVELOPMENT

Figure 1A:
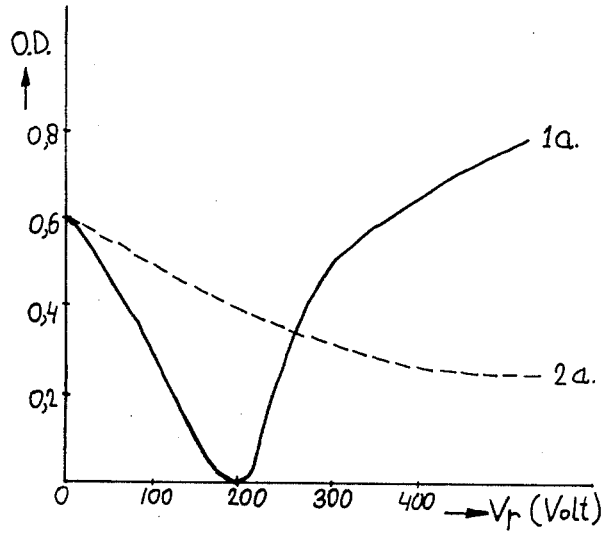

The present invention relates to a process for the reversal development of an electrical potential pattern formed by an electrophotographic process.

In electrophotography an insulating photoconductive layer is uniformly charged, followed by exposure to a light pattern to create an electrical potential pattern which subsequently is developed either with a toner powder or with a dispersion of colored marking particles dispersed in an electrically insulating liquid. The developed image is either directly fixed on the photoconductive layer or transferred to another substrate and subsequently fixed thereon.

Most of the developing powders used are two-component powders which comprise colored toner particles and carrier particles that effect triboelectric charging of the toner particles. On the other hand, one-component developing powders are also used. They consist essentially of toner particles which are inductively attractable by the electrical potential pattern and generally have a resistivity of between $10^3$ and $10^{13}$ Ωcm.

The development step is referred to as positive development if the toner particles are deposited on those parts of the insulating photoconductive layer which are not struck by light during the imagewise exposure; it is referred to as negative or reversal development if the particles are deposited on the parts of the photoconductive layer struck by light.

Liquid developers are usually used for reversal development, which heretofore has been used principally for the enlargement of negative microfilms. Reversal development with the use of two-component developing powders has a number of restrictions. One-component developers, although also suggested for the purpose in literature, have hardly found practical use in reversal development. Problems have existed in their use in that copies could not be obtained which were completely or practically completely free of background, and the process could not be well controlled British patent specifications No's. 945 052 and 959 668 disclose electrophotographic reversal development processes in which an electrically conductive donor member brings an inductively attractable one-component developer into contact with the surface that carries the electrical potential pattern. The conductive donor member either is electrically floating or is held at a potential about equal to the highest potential of the electrical potential pattern. The inductively attractable one-component developer powder consists of powdered metal or powdered carbon having particles of sizes below 20 μm (preferably below 5 μm). Amorphous selenium is mentioned as the photoconductor to be used.

British patent specification No. 1 412 350 discloses a reversal development process in which a one-component developer is used for developing a potential pattern on a photoconductive layer made of evaporated selenium compounds, a pigment-binder layer comprising e.g. CdS or ZnO as the photoconductive pigment, or a polymeric organic photoconductor such as poly-N-vinylcarbazole. The electrical potential pattern is formed on the photoconductive layer in the conventional way, viz. by the application of a uniform electric charge followed by exposure to a light pattern whereby the electrostatic charge in the light-struck areas leaks away. Then the potential pattern is developed by means of a magnetic brush device which brings a relatively conductive toner powder ($10^4$–$10^{13}$ Ωcm) in contact with the surface to be developed. The toner powder comprises colored material, a thermoplastic resin and magnetizable material and has particles of sizes between 0.5 and 100 μm, preferably between 2 and 30 μm. The magnetic brush device comprises a conductive development roller, e.g. in the form of a metal cylinder, which rotates around a magnet or magnet sections situated inside the cylinder and can be provided with the required potential. In case of reversal development a unidirectional direct current source provides the conductive metal cylinder with a potential of the same polarity and of the same order of magnitude as the surface potential of the photoconductive layer.

The present invention is based upon the discovery that by applying one of the inductively attractable one-component developers mentioned above, reversal development can be effected with good results if the uniform electric charge provided on the photoconductive layer is restricted to a level sufficiently below the breakdown voltage of the photoconductive layer that the contact between the photoconductive layer and the developing powder during development is insulating. It has been found that, in this way, copies can be obtained which are completely or almost completely free of any background.

The present invention, therefore, provides a process for reversal development in which an electrical potential pattern obtained by uniformly charging a photoconductive layer applied on a conductive support, followed by imagewise exposure of the layer to light, is made visible by bringing a magnetisable and inductively attractable toner powder into contact with the surface of the photoconductive layer by means of a magnetic brush device comprising a conductive development roller connected with a source of a unidirectional direct current by which the roller can be provided with an electrical potential suitable for reversal development, in which process the photoconductive layer is charged only to a level sufficiently below its breakdown voltage that the contact between its surface and the toner powder during the development step is insulating.

In the context of the present invention the contact between a photoconductive layer and a toner powder during the development step of the imaging process is considered insulating if the relation between the value of the potential $V_r$ provided on the conductive surface of the development roller of the magnetic brush device, plotted as the Abscissa of a system of rectilineal co-ordinate axes, and the value of the optical density OD of the layer of toner powder deposited on the photoconductive layer at the potential $V_r$, plotted as the ordinate on the Y axis, is represented by a graph having approximately the shape of a V the lowest point of which touches or practically touches the X axis. If a graph of such values so plotted, hereinafter referred to as the $V_r$-OD graph, has its lowest point at a substantial distance above the X axis and does not rise or hardly rises further notwithstanding a further increase of the potential $V_r$, background-free reversal development appears to be impossible. The contact between the surface of the photoconductive layer and the toner powder in such a case is referred to as injecting contact.

FIG. 1A of the accompanying drawings illustrates the $V_r$-OD graphs obtained for a certain photoconductive element. In that figure the dotted line 2a indicates the course of the $V_r$-OD graph in the case of injecting contact between the surface of the photoconductive layer and the toner powder applied in the reversal development, while the continuous line 1a indicates the course of the $V_r$-OD graph in the case of insulating contact.

Figure 1B:
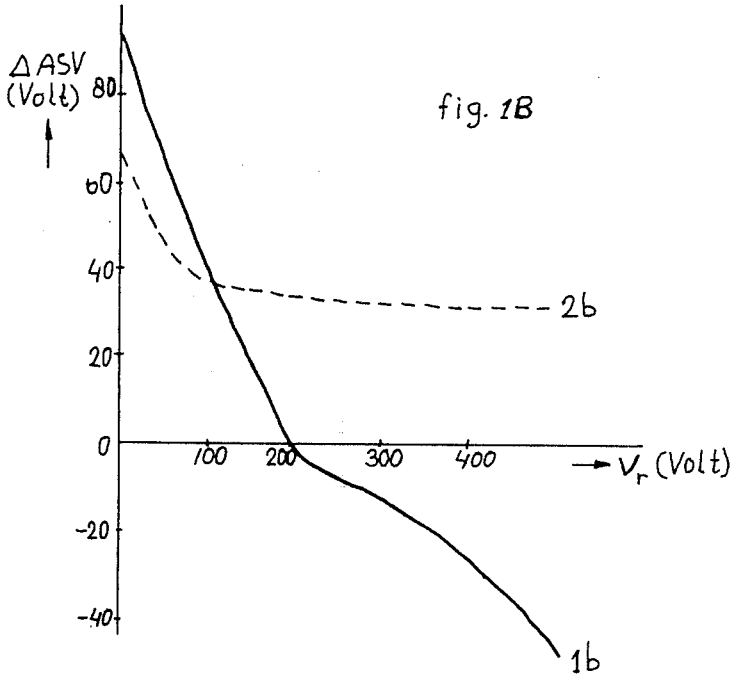

FIG. 1B of the drawings illustrates the course of a $V_r$-ΔASV graph for the same photoconductive element as used for FIG. 1A. The value ΔASV is the difference, corrected for dark decay, between the ASV (apparent surface voltage) of the photoconductive layer before and after the reversal development step has been carried out. The dotted line 2*b* in FIG. 1B represents the course of said graph in the case of the photoconductive layer having been charged up to its breakdown voltage, as a result of which the contact between the photoconductive layer and the toner powder is injecting, while the continuous line 1*b* shows the course of said graph in the case of the photoconductive layer having been charged only to a level at which said contact is insulating. From the course of the graphs 2*b* and 1*b* it can be seen that an injecting contact is characterised by the fact that the $V_r$-ΔASV graph never intersects the X axis, but ultimately continues at some distance approximately parallel to the X axis, while an insulating contact is characterized by the fact that the $V_r$-ΔASV graph intersects the X axis. Generally the intersection occurs at a $V_r$ value approximately the same as that at which the lowest point of the $V_r$-OD graph occurs. The $V_r$-ΔASV graph can be used instead of the $V_r$-OD graph, or, preferably, in addition to and for verification of the $V_r$-OD graph. The $V_r$ΔASV graph is obtained by plotting on the X axis the values of the potentials $V_r$ applied to the surface of the conductive development roller, and on the Y axis the corresponding ΔASV values.

The $V_r$-OD graph can also be used as an aid for determining the minimum level below the breakdown voltage to which the uniform charge to be provided on the photoconductive layer should be limited in order to have insulating contact between the surface of said layer and the applied toner powder during the development step. For this purpose one can proceed, for example, as follows:

A specimen of a photosensitive element which comprises the photoconductive layer to be investigated is mounted in a testing apparatus the development section of which corresponds to that of an electrophotographic apparatus in which the photosensitive element is later to be used. To start with, the $V_r$-OD graph of the element when charged up to its breakdown voltage is determined in the way described hereinbefore. During this determination the potential on the surface of the conductive development roller is raised in steps of 10V each from zero to approximately twice the value of the ASV applied on the photoconductive layer. The course of the $V_r$-OD graph obtained in this way will be of the same kind as that of the dotted line 2*a* of FIG. 1A, that is to say, the lowest point of the graph will remain at some distance above the X axis and thereafter the graph will not rise or will hardly rise when $V_r$ is increased further. This means that the contact between the photoconductive layer and the applied toner powder is injecting, and in the case of reversal development being employed the copies obtained will always show a background the value of which approximately corresponds with the OD value at the lowest point of the $V_r$-OD graph obtained under the condition above described.

Subsequently the $V_r$-OD graph is determined for the case in which the photoconductive element has been charged only to a level corresponding to 95% of its breakdown voltage. Then the $V_r$-OD graph determination is repeated over and again, each time at a charge level lying 5% below the preceding level, until the $V_r$-OD graph obtained has approximately the shape of the continuous line 1a of FIG. 1A; that is to say, until the graph at its lowest point touches the X axis and thereafter rises again with further increasing $V_r$ values. Finally the graph will have a practically symmetrical V-shape. The charge level at which the shape is obtained is the maximum level to which the photoconductive layer of the element investigated may be charged in order to obtain copies completely free of background in reversal development.

From the $V_r$-OD graph that indicates the maximum ASV value to which the investigated photosensitive element may be charged in order to get background-free copies in reversal development, one can also derive the value of the potential to be applied to the surface of the conductive development roller in order to effect reversal development. The value of this potential corresponds to the $V_r$ value at the lowest point of the $V_r$-OD graph, where it touches or almost touches the X axis. This value is referred to hereinafter as the compensation voltage. Generally the $V_r$-OD graph touches or almost touhes the X axis over a distance of about 10 to several tens of volts, which means that the compensation voltage has a relatively broad range.

The compensation voltage generally lies between 0.8 and 1.5 times the ASV value applied to the photoconductive layer. The compensation voltage therefore is higher the higher the ASV of the photoconductive layer. Since in its turn the optical density of the copy (hereinafter called OD-copy) obtainable with the present reversal development process increases as the compensation voltage is increased, the photoconductive layer preferably will be charged up to the value maximally allowable for background-free reversal development. In this way, a maximum OD-copy can be obtained.

For many photoconductive layers it has been observed that when charging them up to 95% of their breakdown voltage, the contact between the photoconductive layer and the toner powder is sufficiently insulating to keep the background in the case of reversal development at an OD between 0.02 and 0.05. Such a background may in some cases still be acceptable since it is completely uniform. For a reversal development which yields copies that are completely free of background, the photoconductive layer generally should be charged at most up to 75% of its breakdown voltage. It will be evident to those skilled in the art that the charging percentages mentioned hardly can be more than a general directive and that the exact percentage has to be determined in one of the two ways given above, because, among other things, the percentage depends on the kind of photoconductive layer used and its thickness. For the same kind of photoconductive layer said percentage decreases with increasing layer thickness. Since it has been observed that the service lifetime of a photoconductive layer increases when the applied ASV is lower, the photoconductive layers used for the present process preferably are layers which still give an acceptable OD-copy at apparent surface voltages (ASV's) of at most 35 to 75% of their breakdown voltage. This applies especially to photoconductive layers of elements which are to be used continually as a permanent master for producing multitudes of copies in an indirect electrophotographic process.

In principle, photoconductive layers of all the known types can be employed in the process of the invention, such as, for example, selenium layers, layers which comprise an organic photoconductor, such as layers based on a polymeric photoconductor, e.g. polyvinyl carbazole, or on a monomeric photoconductor such as 4,4'-diethylaminophenyl-3,5-oxadiazole in a polymeric binder, as well as pigment-binder layers containing an inorganic or organic photoconductive pigment. If desired a protective and/or charge transporting layer can be applied on top of the photoconductive layer, such for example as disclosed in British patent specifications No.'s. 1 337 228 and 1 370 197.

Photoconductive layers which have been found particularly suitable for use in the present process are those based on polyvinyl carbazole and activated with an electron acceptor such as trinitrofluorenone, as well as photoconductive layers which comprise a polymeric photoconductor such as polyvinyl carbazole as a charge transporting matrix and an organic photosensitive pigment dispersed therein. Photosensitive pigments found to be especially useful in such polymeric layers are the bisazo pigments disclosed in British patent specifications No's. 1 370 197, 1 513 418 and 1 520 590, in particular 4,4'-[(3,3'-dichloro [1,1'-biphenyl]-4,4'-diyl) bis (azo)] bis [3-hydroxy-4-phenyl-2-napthalene carboximide], 4,4'-[(3,3'-dimethoxy [1,1'-biphenyl]-4,4'-diyl) bis (azo)]bis [3-hydroxy-N-isopropyl-2-napthalene carboxamide], and 4,4'- [(1,1'-(1,2-ethenediyl) bis (3- chlorobenzene)-4,4'-diyl) bis (azo)] bis [3-hydroxy-N-phenyl-2-napthalenecarboxamide].

Especially good results can be obtained according to the present process with the use of photoconductive layers which comprise "pink" zinc oxide dispersed in a film forming binder. "Pink" zinc oxide, which has a pink or salmon color, is prepared by treating a suitable zinc oxide with carbon dioxide and gaseous ammonia until its weight has increased by approximately 4 to 9% and subsequently heating the product so obtained to a temperature of approximately 250°–275° C. until the weight remains constant. The zinc oxide to be used for the preparation of the "pink" zinc oxide can be a photoconductive zinc oxide, such for example as that identified by the trade names Neige C, Photox 80 and Electrox 2500, or a so-called continuous tone zinc oxide such as those available commercially. Detailed disclosures about "pink" zinc oxide can be found, for instance, in British patent specification No.

Any film forming polymer known for this purpose can be used as the binder for the "pink" zinc oxide-binder layer. The binder can be insulating or it can have a long acceptance range for charge carriers of the desired polarity. Examples of suitable binders are found, for instance, in the above mentioned British patent specification No. 1,412,350. The weight ratio of zinc oxide to binder can vary within wide limits, but preferably lies between 3:1 and 4:1. Further, the "pink" zinc oxide-binder layer may contain sensitizers, activators or other additives as known in the art.

The photoconductive layer to be used in the process of the invention is applied on a conductive support of a kind known per se. The support, for example, can be a metal support or a paper, or a synthetic resin support that has been made sufficiently conductive by conductive substances, such as finely divided carbon. For indirect electrophotography a support preferably is used which has the form of an endless or finite belt. Especially suitable photoconductive belts are disclosed, for example, in the published Dutch patent applications Nos. 7214704, 7217484 and 7607044.

A scorotron is preferably used for uniformly charging the photoconductive layer in the process of the invention. Since the charge applied on the photoconductive layer must be restricted to a certain level below the breakdown voltage of the layer, which in most cases means below its maximum ASV, the use of a conventional corona discharge device (often called a corona) easily can result in the surface charge not being sufficiently uniform. If such disuniformity exceeds a certain level, it may become practically impossible to find a compensation voltage at which background-free reversal development will be obtained. The background that would then arise would be particularly annoying since it is disuniform of nature.

The scorotron preferably used in the process comprises a grid having a relatively large number of wires, e.g. 5 to 10 wires per cm. It has been found that with such a scorotron a surface charge of exactly the desired voltage and of highest uniformity can be applied on the photoconductive layer.

A corona of conventional type can also be used for the charging if the photoconductive layer is first charged up to its breakdown voltage and subsequently is discharged, as by integral exposure to light, to the level desired for background-free reversal development. The surface charge obtainable in that way is sufficiently uniform that, with insulating contact between the photoconductive layer and the toner powder, background-free copies can be obtained by reversal development. As explained hereinbefore, however, such a method causes a faster aging of the photoconductive layer than in the case of the layer being directly charged to the desired level with a scorotron; so it is less desirable for use in an indirect electrophotocopying process.

A magnetic brush developing device of any of the types known in the art may be employed in the process of the invention. A suitable type of such device is described, for instance, in the above-mentioned British patent specification No. 1,412,350. The magnetic brush device preferably used is one in which the conductive roller rotates around a stationary magnet section, and to which the toner powder required for the development of the electrical potential pattern formed on the photoconductive layer usually is brought from a reservoir situated close to the conductive roller. As this roller is rotated it takes up by magnetic attraction some of the magnetizable toner powder from the reservoir. The attracted toner powder arranges itself on the roller surface along the magnetic lines of force and thus forms a magnetic brush presenting alternating crests and valleys. The height of the crests preferably is limited by means of an adjustable scraper which usually is mounted close to the toner powder reservoir.

Toner powders suitable for use in the process of the invention are disclosed, for instance, in the above-mentioned British patent specification No. 1,412,350. The toner powders described in British patent specification No. 1,406,983 are particularly useful. Other known types of magnetisable and inductively attractable toner powders, however, may also be employed in the present process. Generally the useful toner powders have a specific resistance of $10^6$–$10^{10}$ Ωcm and have particle sizes in the range between 5 and 30 μm, and preferably between 8 and 20 μm. The toner powders found most advantageous in the process of the invention have a specific resistance of between $10^7$ and $10^8$ Ωcm; they yield images having a particularly high optical density.

The process of the invention can be used in direct electrophotography, where the visable image produced is fixed directly on the photoconductive layer, as well as in indirect electrophotography where the visable image produced on the photoconductive layer is transferred to a receptor sheet, usually plain paper, and subsequently is fixed thereon. Useful electrophotographic methods are well known to those skilled in the art.

Ways of practicing the invention will be further evident from the following illustrative examples:

EXAMPLE 1

A photoconductive element was used having the following construction and composition:

Support: Melinex which for obtaining the desired conductivity (surface resistance of $10^3$ Ωper square) was provided on both sides with a layer of carbon (Corax L) dispersed in polyvinyl-butyral.

Photoconductive layer: "Pink" zinc oxide-binder layer. As binder Synolac 620 was used, i.e., a 60% by wt. solution in toluene of a styrene/acrylate (50/50) copolymer having a molar mass of approximately 50,000. The weight ratio zinc oxide to binder was 4:1. The $ASV_{max}$ (breakdown voltage) was 290 V.

Thickness of the photoconductive layer: 12 μm.

Thickness of the photosensitive element: about 100 μm.

Form of the element: endless belt.

The velocity of the belt during the experiments was 10 m/min.; the peripheral velocity of the development roller was 60 m/min.

The photoconductive layer was charged by a scorotron to 200 V. The toner powder consisted of a mixture of 47.5% by wt. of the magnetic pigment Bayferrox 318M and 47.5% by wt. of a polyester resin (Atlac 382E), a propoxylated bisphenol A-fumarate polyester resin having a glass transition temperature of 50° C., an acid number of 10 to 15 mg KOH/g, and a viscosity of approximately 1 s.Pa as determined by testing 40% by wt. of the resin in 60% by wt. of butyl diglycol at 25° C. in a Brookfield viscosimeter. Said mixture was kneaded and subsequently cooled down and milled. Thereafter the surface of the toner powder so obtained was coated with 5% by wt. of carbon black. The specific resistance of the toner powder amounted to $10^7$ Ωcm.

The photoconductive belt was brought opposite to the development roller by passing it over a guide roller parallel thereto. The distance between the two rollers was 1.5 mm, the distance between scraper and development roller 0.8 mm. A voltage lying between 190 and 230 V was applied to the conductive surface of the development roller in order to effect reversal development. The optical density of the copies obtained by the reversal development was 1.0 after fixing. The copies were completely free of background.

EXAMPLE 2

An element of the following construction and composition was used:

Support: Melinex coated with a layer of evaporated palladium. Photoconductive layer: Polyvinyl carbazole (PVK) with trinitrofluorenone (TNF) as activator; molar ratio PVK/TNF 10:8.

Thickness of photoconductive layer: 10 μm.

Thickness of photoconductive element: 110 μm.

$ASV_{max}$photoconductive layer: 600 V (break-down voltage).

The above element was charged by a scorotron to a level of 250 V.

Figure 2A:
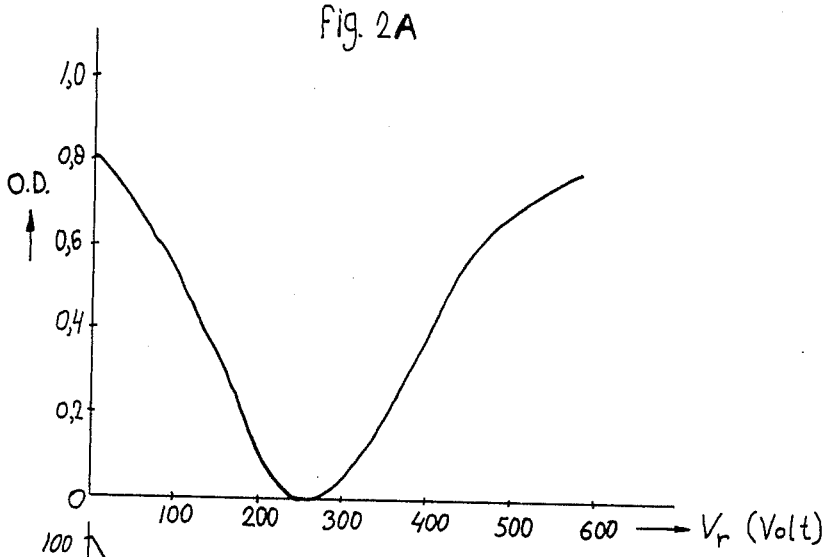
Figure 2B:
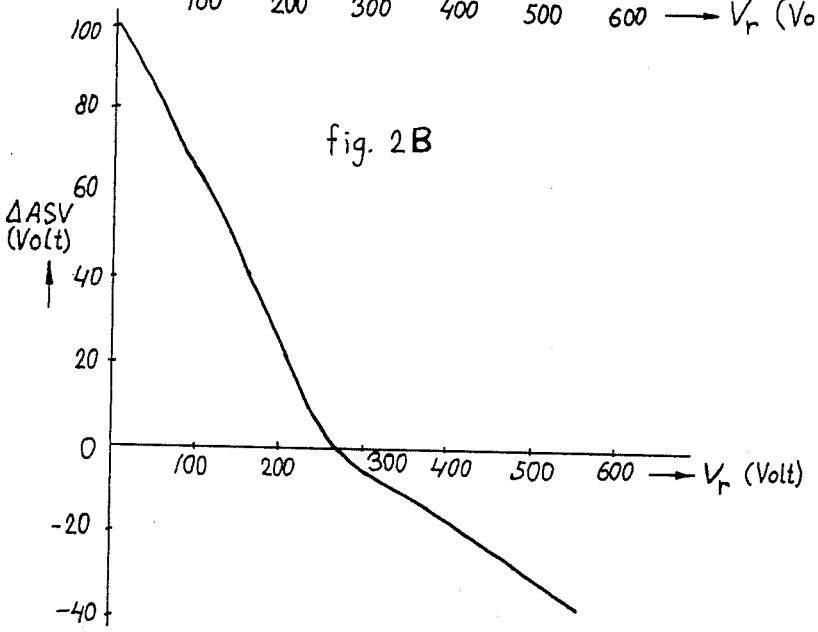

The $V_r$-OD and $V_r\Delta ASV$ graphs were determined for the photoconductive layer and are represented in FIGS. 2A and 2B of the drawings. These graphs are typical for an insulating contact between toner powder and photoconductive layer.

The same toner powder as described in Example 1 was used for the development. The compensation voltage was 260 V. The copies produced were completely free of background.

EXAMPLE 3

Support: Melinex coated with evaporated palladium.

Photoconductive layer: PVK/TNF as binder containing Phenelac Blue as photoconductive pigment. Molar ratio PVK/TNF, 10:1; weight ratio PVK/TNF: pigment, 5:1.

Thickness of photoconductive layer: 3 μm.

Thickness of photoconductive element: 110 μm.

$ASV_{max}$of photoconductive layer: 300 V (breakdown voltage).

The above element was charged by a scorotron to 200 V. The compensation voltage was 220 V.

The development took place with a toner powder having a resistivity of $4 \times 10^7$ Ωcm.

The contact between toner powder and photoconductor was insulating, and the copies obtained with reversal development showed no background.

EXAMPLE 4

For this experiment a photoconductive element of the following construction and composition was used:

Support: as described in example 1; the wt. ratio of carbon black to binder was 2:5.

Photoconductive layer: "Pink" zinc oxide-binder layer. The "pink" zinc oxide was made from "Photox 80". The binder was a styrene-ethylacrylate copolymer having an acid number of 17 (product E048 of De Soto Inc., USA) in the form of a 50% by wt. solution in a mixture of toluene, xylene and propanol. Ratio of zinc oxide to binder, 4:1. $ASV_{max}$ was approximately 150 V.

Thickness of photoconductive layer: 7 μm.

Thickness of photoconductive element: 100 μm.

Form of the element: endless belt.

The speed of the belt during the experiment was 15 m/min., the peripheral speed of the development roller 50 m/min.

The toner powder was composed of 47.5 wt. % of magnetic pigment, 47.5 wt. % of a polyester resin (Atlac 382) and 5 wt. % of carbon black, thoroughly mixed with each other. The specific resistance of the toner powder was $10^7$ Ωcm.

The photoconductive belt was brought opposite the development roller by means of a guide roller. The distance between the parallel rollers amounted to 1250 μm, the distance between scraper and development roller 800 μm.

The optimal compensation voltage amounted to 160–180 V.

The optical density of the copies produced by reversal development was observed to be 1.0 after fixing. The OD-background was 0.005.

Reversal copies substantially free of background could be obtained with the photoconductive element of this example even when the element was charged to its maximum ASV. The explanation for this may be that the $ASV_{max}$ of such an extremely thin "pink" zinc oxidebinder layer apparently does not reach the level of its breakdown voltage. When employing an element of such a type in the process of the invention, a conventional corona may be used to apply the required uniform charge.

What is claimed is:

1. In a process for reversal development which comprises forming an electrical potential pattern by uniformly charging and thereafter imagewise exposing to light a photoconductive layer on a conductive support and developing said pattern into a visible image by contacting the surface of said layer with magnetizable and inductively attractable toner powder carried on a conductive surface of a magnetic brush development device, said conductive surface being provided with an electrical potential suited for charging particles of said powder so as to deposit them on exposed image areas of said pattern by reversal development, the improvement which comprises effecting said charging of the photoconductive layer only to a charge level sufficiently below the breakdown voltage of said layer and so related to the potential on said conductive surface that the contact between said layer surface and the toner powder is insulating during the development of the potential pattern, said charge level being such that when said photoconductive layer uniformly charged to said level is contacted with said powder in a series of tests differing from one another by variations of a potential (Vr) applied to said conductive surface, the respective resulting values of the optical density (OD) of the toner powder deposited on said layer are represented by a graph having at least approximately the shape of a V with the lowest region thereof representing an OD value of zero or nearly zero.

2. A process according to claim 1 or 23, said charge level being one at which the apparent surface voltage of the photoconductive layer amounts to at most 35 to 75% of its breakdown voltage.

3. A process according to claim 1 or 23, said photoconductive layer being one which comprises a photoconductive polymer including polyvinyl carbazole and contains an electron acceptor for activating said polymer.

4. A process according to claim 1 or 3, said photoconductive layer being one which comprises a photoconductive polymer including polyvinyl carbazole or the same with an electron acceptor and which also contains a photosensitive bisazo pigment.

5. A process according to claim 4, said pigment comprising 4,4'-[(3,3'-dichloro[1,1'-biphenyl]-4,4' diyl) bis (azo)] bis [3-hydroxy-4-phenyl-2-naphthalene carboxamide].

6. A process according to claim 4, said pigment comprising 4,4'-[(3,3'-dimethoxy[1,1'-biphenyl]-4,4'-diyl) bis (azo)] bis [3-hydroxy-N-isopropyl-2-naphthalenecarboxamide].

7. A process according to claim 4, said pigment comprising 4,4'-[(1,1'(1,2-ethenediyl) bis (3-chlorobenzene)-4,4'-diyl) bis (azo)] bis [3-hydroxy-N-phenyl-2-naphthalenecarboxamide].

8. A process according to claim 1 or 3, said photoconductive layer being one which comprises "pink" zinc oxide in a film forming binder.

9. A process according to claim 1 or 17, said toner powder having a resistivity of $10^7$ to $10^8$ Ωcm.

10. A process according to claim 1 or 17, the value of the electrical potential applied to said conductive surface being 0.8 to 1.5 times that of the apparent surface voltage applied to the photoconductive layer by said charging.

11. A process for reversal development which comprises uniformly charging a photoconductive layer on a conductive support by means of a scorotron the grid of which comprises 5 to 10 wires per cm, thereafter exposing said layer to light so as to form on said layer a potential pattern, and developing the potential pattern into a visible image by contacting the surface of said layer with magnetizable, inductively attractable toner powder carried on a conductive surface of a magnetic brush developing device with said conductive surface impressed by a unidirectional direct current to an electrical potential suited for charging particles of said powder so as to deposit them on exposed image areas of said pattern by reversal development, said powder having a resistivity of between $10^6$ and $10^{10}$ ohm.cm and its particle sizes being in the range of 5 to 30 microns, said charging being effected up to a charge level of said layer amounting at most to 35 to 75% of its breakdown voltage and so related to said impressed potential that the apparent surface voltage of said layer, corrected for dark decay, is approximately the same after as before the development of said charge pattern, said impressed potential being at a value 0.8 to 1.5 times that of the apparent surface voltage applied to said layer by said charging.

12. A process according to claim 11, said photoconductive layer comprising a photoconductive polymer including polyvinyl carbazole or the same with an electron acceptor, and also containing a photosensitive bisazo pigment.

13. A process according to claim 11, said photoconductive layer being a dispersion of "pink" zinc oxide in a film forming binder.

14. A process according to claim 1, said development being effected with said potential on said conductive surface substantially corresponding to the value of said potential Vr at the lowest point of said graph.

15. A process according to claim 1 or 14, said charge level being such that said graph has a substantially symmetrical V shape with its lowest point representing an OD value of zero.

16. A process according to claim 1 or 14, said charge level being so related to the potential provided on said conductive surface that the apparent surface voltage of the photoconductive layer, corrected for dark decay, is approximately the same after as before the development of said potential pattern.

17. In a process for reversal development which comprises forming an electrical potential pattern by uniformly charging and thereafter imagewise exposing to light a photoconductive layer on a conductive support and developing said pattern into a visible image by contacting the surface of said layer with magnetizable and inductively attractable toner powder carried on a conductive surface of a magnetic brush development device, said conductive surface being provided with an electrical potential suited for charging particles of said powder so as to deposit them on exposed image areas of said pattern by reversal development, the improvement which comprises effecting said charging of the photoconductive layer only to a charge level sufficiently below the breakdown voltage of said layer and so related to the potential provided on said conductive surface that the apparent surface voltage of the photoconductive layer, corrected for dark decay, is approximately the same after as before the development of said charge pattern.

* * * * *

UNITED STATES PATENT OFFICE

CERTIFICATE OF CORRECTION

Patent No. 4,286,036 Dated August 25, 1981

Inventor(s) ROELOF R. HENDRIKSMA

It is certified that error appears in the above-identified patent and that said Letters Patent are hereby corrected as shown below:

Col. 4, line 10: In place of "the" read -- that --.

Col. 5, line 50: After "No." insert -- 1,489,793 --.

Col. 9, line 3 : In place of "idebinder" read -- ide-binder --.

Col. 9, claims 1 and 2, line 1 of each: In place of "23" read -- 17 --.

Col. 9, claims 4 and 8, line 1 of each: In place of "3" read -- 17 --.

Signed and Sealed this

First Day of December 1981

[SEAL]

Attest:

GERALD J. MOSSINGHOFF

Attesting Officer

Commissioner of Patents and Trademarks